US007032790B2

(12) United States Patent
Williamson, IV et al.

(10) Patent No.: US 7,032,790 B2
(45) Date of Patent: Apr. 25, 2006

(54) CONTAINER, SEALING CAP AND METHOD FOR SEALING A NOZZLE TIP OF A CURABLE LIQUID DISPENSING CONTAINER

(75) Inventors: Warren P. Williamson, IV, Loveland, OH (US); Craig B. Berky, Milford, OH (US)

(73) Assignee: Long-Shot Products, Ltd., Loveland, OH (US)

( * ) Notice: Subject to any disclaimer, the term of this patent is extended or adjusted under 35 U.S.C. 154(b) by 249 days.

(21) Appl. No.: 10/624,004

(22) Filed: Jul. 21, 2003

(65) Prior Publication Data

US 2004/0016776 A1 Jan. 29, 2004

Related U.S. Application Data

(63) Continuation of application No. PCT/US02/02510, filed on Jan. 29, 2002.

(60) Provisional application No. 60/265,226, filed on Jan. 31, 2001.

(51) Int. Cl.
*B67D 3/00* (2006.01)

(52) U.S. Cl. ..... 222/542; 222/562

(58) Field of Classification Search ..... 220/784, 220/795, 796, 806; 215/341, 438; 222/327, 222/542, 562
See application file for complete search history.

(56) References Cited

U.S. PATENT DOCUMENTS

| | | | | |
|---|---|---|---|---|
| 152,980 | A | 7/1874 | Donkin | |
| 193,760 | A | 7/1877 | Hauck | |
| 1,137,086 | A | 4/1915 | Rodiger | |
| 1,991,523 | A | 2/1935 | Robinson | 221/33 |

(Continued)

FOREIGN PATENT DOCUMENTS

DE 19720937 10/1998

*Primary Examiner*—Philippe Derakshani
(74) *Attorney, Agent, or Firm*—Wood, Herron & Evans, L.L.P.

(57) ABSTRACT

A cap for curable material dispensing containers prevents the material from curing after opening the dispensing nozzle. Thus, when mounted on a partially-dispensed container, the nozzle cap preserves flowable materials such as air-cured glues, sealants, caulks, etc. In particular, a deformable sealant in the cap remains pliant, conforming in and/or around the nozzle tip to create a seal. A retention member frictionally grips the nozzle to prevent inadvertent release of the cap, yet accommodates nozzle tips cut to varying lengths.

19 Claims, 4 Drawing Sheets

U.S. PATENT DOCUMENTS

| | | | | |
|---|---|---|---|---|
| 2,677,482 | A | 5/1954 | Lehmann | 222/481 |
| 2,731,053 | A | 1/1956 | Lockhart | 150/5 |
| 2,754,033 | A | 7/1956 | Etter | 222/326 |
| 2,849,739 | A | 9/1958 | Dresden | 15/140.3 |
| 2,887,240 | A | 5/1959 | Deussen | 215/52 |
| 3,930,599 | A | 1/1976 | Brothers et al. | 222/143 |
| 3,961,731 | A | 6/1976 | Mochida | 222/390 |
| 4,213,546 | A | 7/1980 | Massey | 222/546 |
| 4,220,811 | A | 9/1980 | Scott | 174/87 |
| 4,248,246 | A | 2/1981 | Ikeda | 128/765 |
| 4,284,213 | A | 8/1981 | Lee | 222/541 |
| 5,023,402 | A | 6/1991 | King, Jr. et al. | 174/87 |
| 5,107,077 | A | 4/1992 | Fox et al. | 174/138 |
| 5,113,037 | A | 5/1992 | King, Jr. et al. | 174/87 |
| 5,154,327 | A | 10/1992 | Long | 222/326 |
| 5,248,071 | A | 9/1993 | Ray | 222/568 |
| 5,480,064 | A * | 1/1996 | Yan | 222/83 |
| 5,980,495 | A * | 11/1999 | Heinz et al. | 604/263 |
| 6,025,559 | A | 2/2000 | Simmons | 174/87 |
| 6,213,349 | B1 * | 4/2001 | Yan | 222/83 |
| 6,485,474 | B1 * | 11/2002 | Heinz et al. | 604/263 |

* cited by examiner

CONTAINER, SEALING CAP AND METHOD FOR SEALING A NOZZLE TIP OF A CURABLE LIQUID DISPENSING CONTAINER

The present application is a continuation of PCT Ser. No. PCT/US02/02510 filed on Jan. 29, 2002 (now pending) which claims the benefit under 35 U.S.C. § 120 of Provisional Application Ser. No. 60/265,226, filed Jan. 31, 2001 (abandoned). The disclosure of that provisional application is hereby fully incorporated by reference herein.

FIELD OF THE INVENTION

This invention relates generally to resealing the open nozzle of any dispensing container of curable material. More specifically, the invention relates to an improved cap for placement on the nozzle of a cylindrical squeeze container or other dispensing cartridge, such as those used in connection with a caulking.

BACKGROUND OF THE INVENTION

Various dispensers are used to dispense curable materials such as sealants, caulks, and glues. Disposable cartridges may be mounted on a gun or the container may be of the type needing to be squeezed to dispense the material. A tapered, plastic nozzle of the container is selectively cut at the desired angle to form a nozzle tip orifice of the desired size. When using a gun, a trigger is squeezed to advance a piston of the gun against a plug of the cartridge. The plug moves into the cartridge to dispense the flowable material through the orifice. In addition to caulking type dispensing tubes, curable material is sometimes in one-piece molded tubes where the nozzle is molded into the tube. The curable material is sealed inside the tube by heat sealing the tube walls much like a toothpaste tube.

Standardized cartridges and squeeze containers, while providing economic packaging of flowable materials, generally are not sized precisely for the desired use. Consequently, a quantity of flowable material remains in partially-dispensed containers between uses. Capping the nozzle tip is important between uses to prevent leakage, but perhaps more importantly to prevent the material in the nozzle tip from curing thus potentially rendering the rest of the uncured material unusable.

Various caps have been used to block the opened nozzle tip with limited success. Many containers have a smooth tapered nozzle that conventional caps cannot adequately seal against. Conventional caps therefore allow air to contact the curable material. Over a short time of hours to weeks, the material in the nozzle, and perhaps the entire container, hardens and the nozzle becomes plugged. The user must resort to somehow clearing a flow path through the nozzle or the container may even become unusable.

Efforts to provide an air-tight seal to prevent this hardening include installing a nail, tape, plastic caps or other object into or on the nozzle tip. However, it is difficult to obtain a good seal and often the flowable material hardens nonetheless. In addition, it is inconvenient to procure a number of objects of varying diameters to accommodate variations in the diameter of the nozzle tip orifice.

Consequently, there exists a significant need for selectively sealing partially-dispensed containers of curable material. Ideally, an economical cap should be provided having the ability to seal various tapered nozzles that have been cut in different locations to yield discharge orifices of different diameter.

SUMMARY OF THE INVENTION

The present invention therefore provides a manner of capping a partially-dispensed curable material container so that flowable contents contained therein do not harden due to exposure to air. Thus, the continued use and convenience of the dispensing container is maintained. In one preferred embodiment, a nozzle tip of the container may be selectively cut to achieve the desired shape and size of nozzle tip orifice. Yet, unused portions of the container remain viable for an extended period of time after opening the nozzle tip.

In an aspect consistent with the invention, a sealing cap, and method for use, includes a hollow elongate body having an open end and a closed end. The body includes an interior space shaped to encompass a portion of the nozzle including the tip. A deformable sealant is located within a portion of the interior space toward the closed end. One or more retention members may be positioned within the interior space of the body to frictionally engage the nozzle when the nozzle tip is inserted into sealing contact with the deformable sealant. The retention member(s) help to secure the cap on the nozzle and may be separate or integral relative to the body. The deformable sealant may also be a separate component inserted into the cap or integrally formed with the cap.

Various advantages, objectives, and features of the invention will become more readily apparent to those of ordinary skill in the art upon review of the following detailed description of the preferred embodiments, taken in conjunction with the accompanying drawings.

DETAILED OF THE PREFERRED EMBODIMENTS

Figure 1:
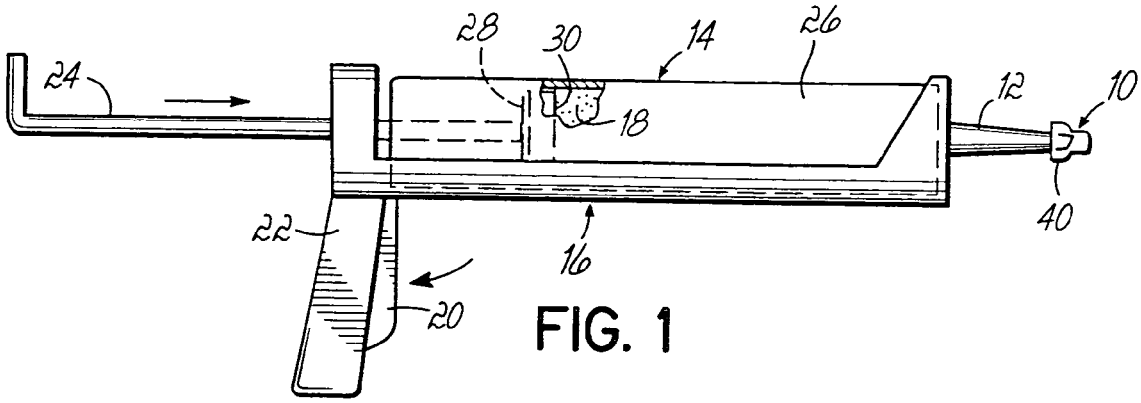
FIG. 1 is a protective sealing cap consistent with aspects of the invention placed on a cartridge loaded in a caulking gun.

Turning to the drawings, FIG. 1 illustrates a protective sealing cap 10 selectively closing a nozzle 12 of a partially-dispensed cartridge 14 mounted on a conventional caulking gun 16. The cartridge 14 contains a quantity of flowable and curable material 18, such as sealants, caulks, glue, etc.

The flowable material 18 is dispensed through the nozzle 12 by repetitively squeezing and releasing a trigger 20 on a handle 22 of the gun 16, which in turn linearly ratchets an L-shaped rod 24 forward into a hollow tube 26 of the cartridge 14. A flat, circular plate 28 attached to the L-shaped rod 24 abuts a plug 30 constrained in the tube 26 to inwardly slide and thereby to expel the flowable material 18.

Figure 2:
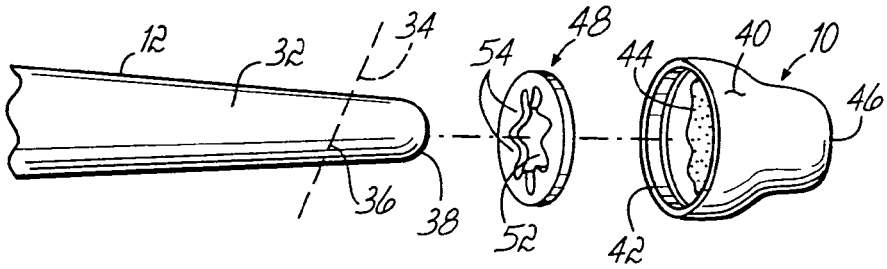
FIG. 2 is an exploded perspective view of the protective sealing cap of FIG. 1 removed from the nozzle of the cartridge.
Figure 3:
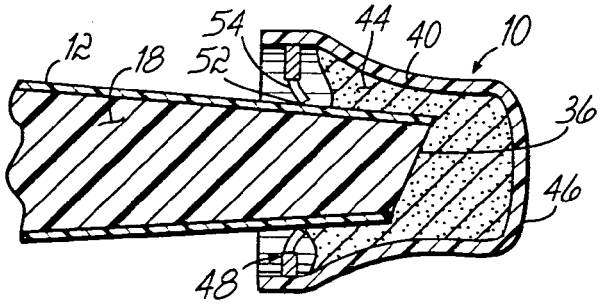
FIG. 3 is a cross-sectional view of the protective cap of FIGS. 1 and 2 mounted on the nozzle of a partially-dispensed cartridge.

With reference to FIGS. 2 and 3, a nozzle tip 32 of the nozzle 12 is depicted prior to cutting along a cut line 34 to form a nozzle tip orifice 36 and a discarded portion 38.

The protective cap 10, consistent with aspects of the invention, includes a hollow, elongate body 40 of a polymer material shaped to receive the nozzle tip 32, both before and after removal of the discarded portion 38, through an open end 42.

A quantity of deformable sealant 44 is contained with the body 40 toward a closed end 46 of the body 40. The amount of sealant 44 is selected to substantially encompass the nozzle tip 32 without being expelled out of the open end 42. Various types of deformable sealant 44 may be used, for example a viscous, uncured silicon gel or wax may be inserted into the cap 10. As one additional alternative, sealant 44 may be integrally formed with the cap, such as by molding a thermoplastic or thermoset low durometer elastomer into the cap 10. Preferably, the type of compound selected for sealant 44 remains pliable, does not tend to flow freely, and does not chemically interact with flowable materials 18. The sealant material 44 may or may not enter the nozzle 12 to aid in sealing. If it does enter nozzle 12, sealant 44 will be easily expelled during the next use.

A retention member, such as an anti-backup clip 48 shaped as a ring, maintains the nozzle tip 34 in sealing contact with the sealant 44. In particular, the anti-backup clip 48 snaps into a peripheral groove 50 across the open end 42 of the body 40. An aperture 52 in the clip 48 is sized to permit inward movement of the nozzle tip 34 of various dimensions. Inwardly projecting barbs 54 inwardly yield as the nozzle tip 32 is inserted and thereafter frictionally engage the nozzle tip 32 to prevent inadvertent dislodging of the cap 10. The clip 48 further assists in containing the sealant 44 within the body 40.

A utility knife or other means is used to remove a discarded portion 38 from the nozzle tip 32 along the desired cut line 34, thus forming the nozzle tip orifice 36. After dispensing a portion of the flowable material 18 from the cartridge 14, the cap 10 is pressed onto the nozzle tip 32 until the nozzle tip orifice 36 is in sealing contact with the deformable sealant 44. A retention member, such as clip 48 attached to the body 40 of the cap 10, frictionally engages the nozzle 12, keeping the cap 10 mounted to the cartridge 14 until manually removed for subsequent dispensing.

By virtue of the foregoing, a protective cap 10 for a caulking gun cartridge 14 includes a deformable sealant 44 to form an air tight seal with the nozzle tip 32, thus preventing hardening of the flowable material 18 in a partially-dispensed cartridge 14.

Figure 4:
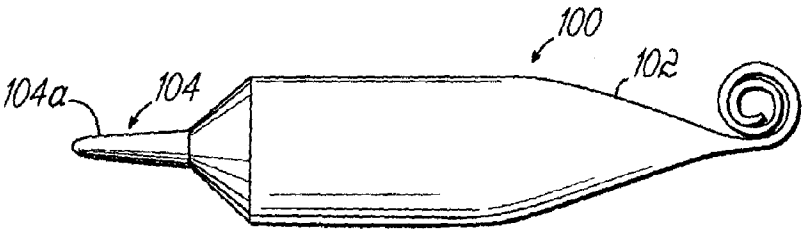
FIG. 4 is a side elevational view of a squeeze container usable in connection with the present invention.
Figure 4A:
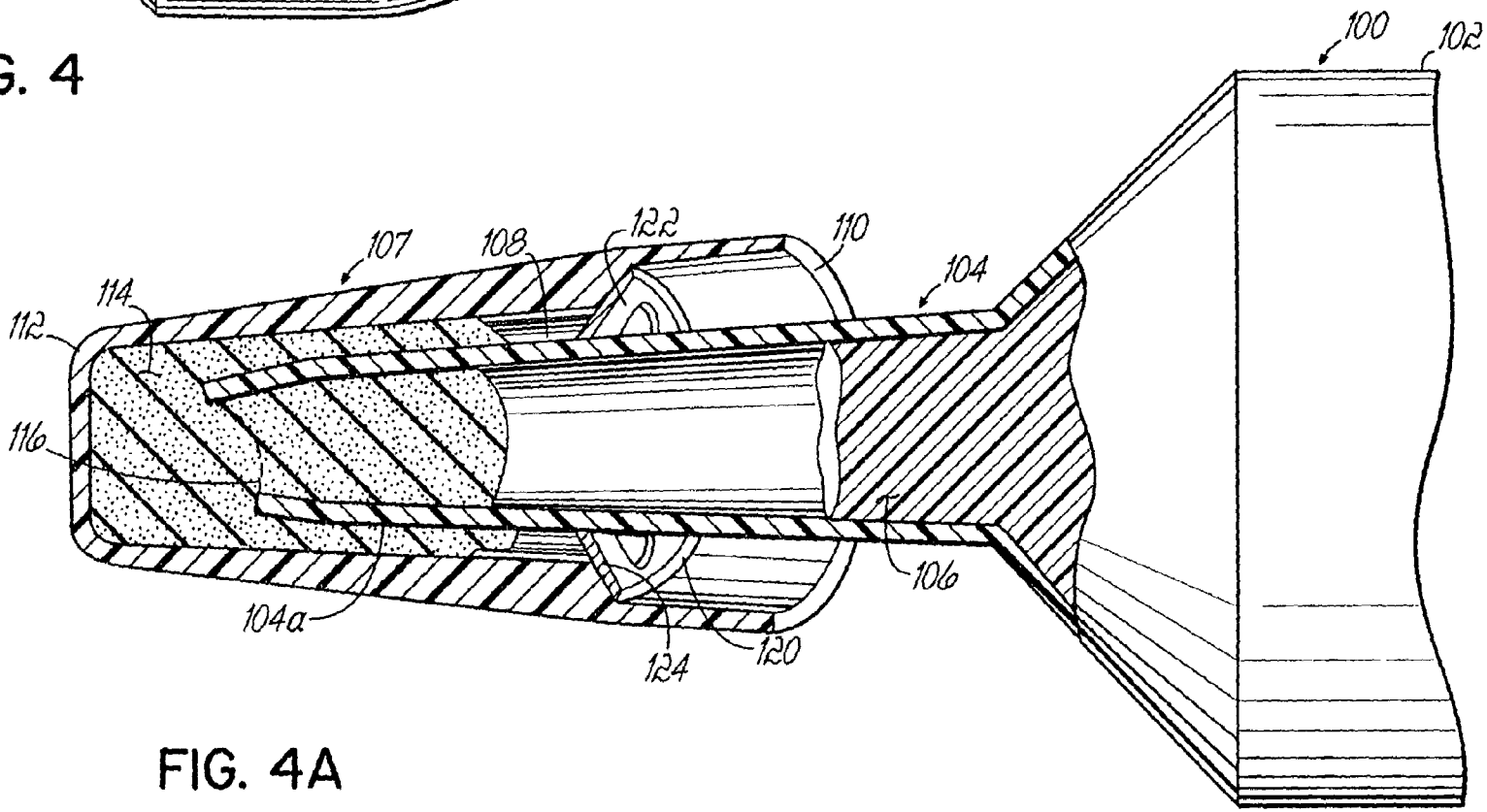
FIG. 4A is a partially cross sectioned view of the nozzle portion of the squeeze container shown in FIG. 4, additionally including a cap constructed in accordance with the invention.

FIGS. 4 and 4A illustrate an alternative type of container 100 which can benefit from the present invention. Particularly, container 100 is a squeeze type of container including a flexible hollow body portion 102 including a nozzle 104 which is preferably tapered and includes a tip 104*a*. As further shown in FIG. 4A, container 100 includes a curable and flowable material 106 and nozzle tip 104*a* receives a cap 107 constructed in accordance with the invention. Cap 107 is a hollow body having an interior space 108, an open end 110 and a closed end 112. Closed end 112 includes a deformable sealant 114, preferably of the type of material described above relative to sealant 44. This sealant 114 may enter nozzle tip 104*a* through orifice 116 as shown to aid in sealing and preventing air from reaching material 106. A retention member 120 including a plurality of projections 122 which engage the outer surface of nozzle 104 is retained against an annular ledge 124 to aid in frictionally retaining cap 107 on nozzle 104.

Figure 5:
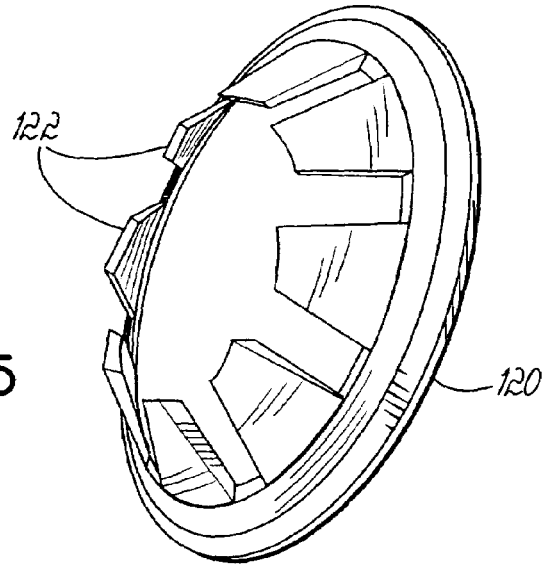
FIG. 5 is a perspective view of a retention member usable in connection with the cap of this invention.

As further shown in FIG. 5, projections 122 of retention member 120 are angled, in this embodiment, to facilitate threading cap 107 on nozzle 104. It will be appreciated that other threadable or push-on types of retention members may be used as well. As another alternative, the retention member may simply be an elastic or resilient portion of cap 107 which frictionally grips the outer surface of nozzle 104.

Figure 6:
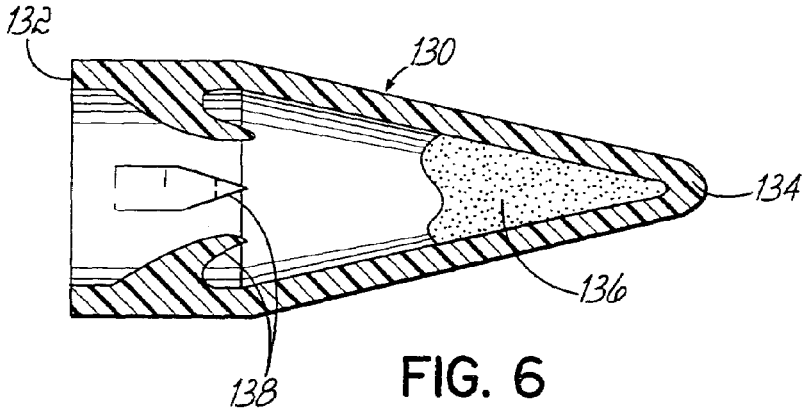
FIG. 6 is a cross sectional view of an alternative cap constructed in accordance with the invention.

FIG. 6 illustrates another alternative cap 130 comprised of a body having an open end 132 and a closed end 134 receiving a deformable sealant 136. In this embodiment, integral projections 138 are utilized as retention members to frictionally grip the outer surface of nozzle 104.

Figure 7:
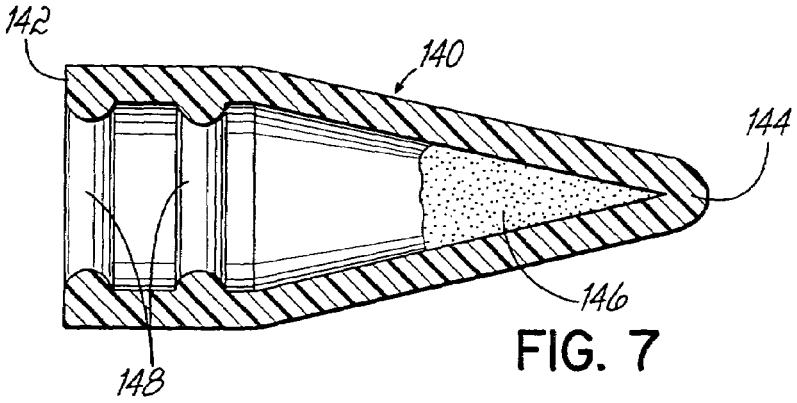
FIG. 7 is a cross sectional view of another alternative cap constructed in accordance with the invention.

As illustrated in FIG. 7, another alternative cap 140 likewise includes an open end 142 and a closed end 144 receiving a deformable sealant 146. Annular projections 148 are disposed proximate open end 142 for frictionally engaging the outer surface of nozzle 104.

Figure 8:
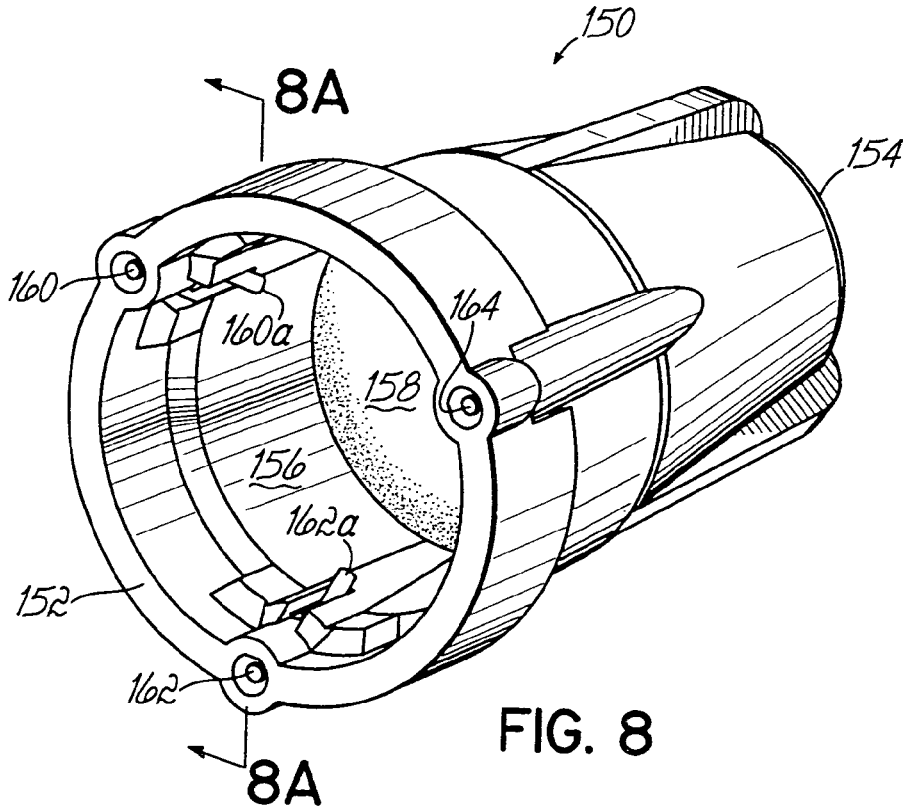
FIG. 8 is a perspective view of another alternative embodiment of a protective sealing cap of this invention.
Figure 8A:
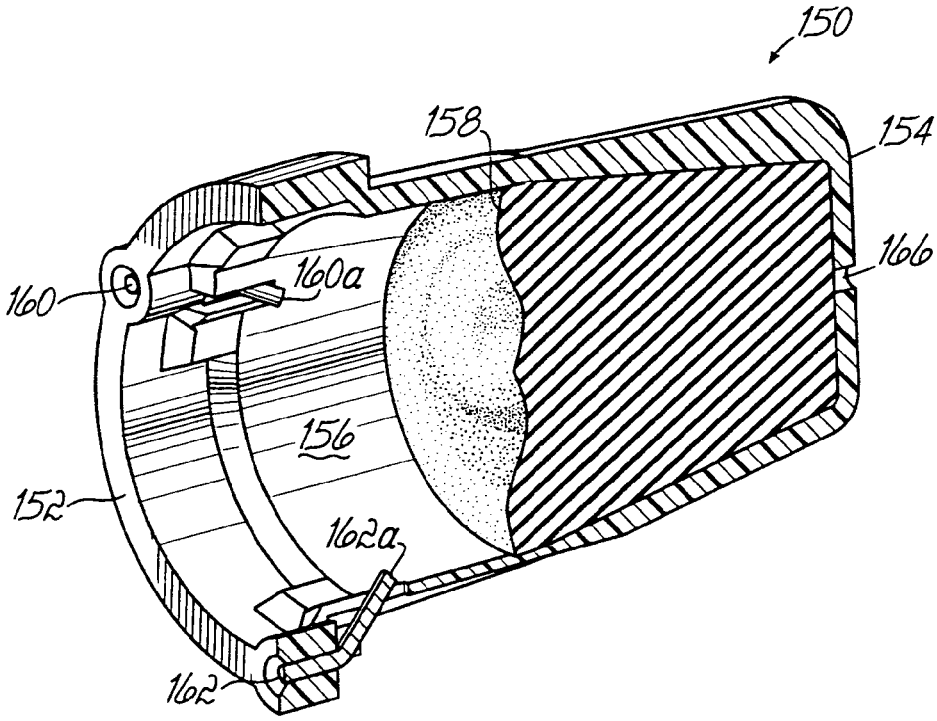
FIG. 8A is a cross sectional view taken along line 8A—8A of FIG. 8.

FIGS. 8 and 8A illustrate another alternative cap 150 of this invention including an open end 152, a closed end 154 and an interior space 156 receiving a deformable sealant 158 toward the closed end. The deformable sealant 158 may be of the type previously described or of a different suitable type in accordance with the principles of this invention. Three retention members 160, 162, 164 are integrally molded within the cap 150 at approximately 120° spaced apart locations. In this embodiment, the retention members 160, 162, 164 comprise short pieces of wire which bend radially inward into the interior space 156 such that the ends 160*a*, 162*a* of each wire preferably engage the nozzle (not shown) of a container having a quantity of flowable and curable material therein, as previously described. The cap 150 may simply be pressed onto the nozzle tip (not shown) until the open orifice or outlet of the tip engages and deforms the sealant 158 in the manner described above. Retention members 160, 162, 164 help to secure the cap 150 onto the nozzle tip until the cap 150 is removed. During removal of cap 150, the ends 160*a*, 162*a* (only two of three being illustrated) of one or more of the retention members 160, 162, 164 may deform as the cap 150 is pulled off of the nozzle tip. The cap is preferably designed for a single use only and, therefore, the used cap 150 may be discarded and replaced by a new cap if the nozzle tip again needs to be sealed after that use. However, there may be situations and embodiments in which re-use is preferred. As one example, if retention members 160, 162, 164 are not damaged, then the user may desire to re-use cap 150. Finally, FIG. 8A shows a small vent hole 166 in the closed end 154 of the cap 150. This is useful to vent the air from the interior space 156 of the cap 150 as the closed end 154 is filled with the deformable sealant material 158.

While one embodiment has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims

We claim:

1. A container for dispensing one of a glue, sealant and caulk, comprising:

a hollow tube containing the glue, sealant or caulk;

a nozzle at one end of the tube, the nozzle having a tip with an outlet to dispense the glue, sealant or caulk, and a sealing cap including a hollow elongate body having an open end and a closed end and an interior space shaped to encompass a portion of the nozzle including the tip and a deformable sealant located within a portion of the interior space toward the closed end and sealing the orifice, the sealant being retained in the outlet of the nozzle and expelled during a subsequent use thereof to dispense the glue, sealant or caulk.

2. The container of claim 1, wherein said nozzle is integrally formed in one piece and further comprising:

a retention member positioned within the interior space for frictionally engaging the nozzle when the nozzle tip is insert into sealing contact with the quantity of deformable sealant.

3. The container of claim 2, wherein the retention member is separable from the body.

4. The container of claim 2, wherein the retention member is integrally formed with the body.

5. The container of claim 2, wherein the retention member includes at least one projection on an internal wall of the body.

6. The container of claim 2, wherein the retention member further comprises a plurality of angled projections configured to facilitate threading the cap onto the nozzle.

7. The container of claim 2, wherein the retention member further comprises a wire having an end extending into the interior space so as to engage said nozzle tip.

8. The container of claim 1, wherein the deformable sealant is selected from the group consisting of a silicon gel and a wax.

9. The container of claim 1, wherein the deformable sealant comprises an elastomer.

10. A sealing cap for a container holding a flowable and curable material, the container further having integral, one-piece elongate dispensing nozzle with an outer surface and a tip, the sealing cap comprising:

a hollow elongate body having an open end and a closed end and an interior space shaped to encompass a portion of the nozzle including the tip;

a deformable sealant located within a portion of the interior space toward the closed end; and a retention member located within the interior space configured to frictionally engage the outer surface of the elongate nozzle when the nozzle tip is insert into sealing contact with the deformable sealant, wherein the retention member further comprises a wire having an end extending into the interior space so as to engage said nozzle tip.

11. The cap of claim 10, wherein the retention member is separable from the body.

12. The cap of claim 10, wherein the retention member is integrally formed with the body.

13. The cap of claim 10, wherein the retention member includes at least one projection on an internal wall of the body.

14. The cap of claim 10, wherein the retention member further comprises a plurality of angled projections configured to facilitate threading the cap onto the nozzle.

15. The cap of claim 10, wherein the deformable sealant is selected from the group consisting of a silicon gel and a wax.

16. The cap of claim 10, wherein the deformable sealant comprises an elastomer.

17. A method of selectively sealing an open nozzle tip of a partially dispensed container of glue, sealant or caulk and subsequently dispensing the glue, sealant or caulk, the container having an elongate, integrally formed nozzle with an outer surface, the method comprising:

placing a deformable sealant material within a closed end of a cap shaped to receive the outer surface and the open nozzle tip;

engaging the cap over the open nozzle tip;

making sealing contact between the open nozzle tip and the deformable sealant material by forcing a portion of the deformable sealant material into the open nozzle tip;

engaging at least one projection of the cap onto the outer surface of the elongate, integrally formed nozzle;

removing the cap from the open nozzle tip leaving a portion of the deformable sealant material within the open nozzle tip; and expelling the portion of the deformable sealant material from the open nozzle tip while dispensing the glue, sealant or caulk from the nozzle.

18. The method of claim 17, wherein the step of engaging at least one projection further comprises:

rotating the cap onto an outer surface of the nozzle tip with a threading action to retain the cap on the nozzle tip.

19. The method of claim 17, further comprising:

cutting an end of the nozzle to form the open nozzle tip prior to engaging the cap over the open nozzle tip.

* * * * *

UNITED STATES PATENT AND TRADEMARK OFFICE

CERTIFICATE OF CORRECTION

PATENT NO. : 7,032,790 B2
APPLICATION NO. : 10/624004
DATED : April 25, 2006
INVENTOR(S) : Warren P. Williamson IV et al.

It is certified that error appears in the above-identified patent and that said Letters Patent is hereby corrected as shown below:

Column 5

Line 21, change “insert” to --inserted--.

Column 6

Line 1, change “insert” to --inserted--.

Signed and Sealed this

Twenty-second Day of August, 2006

JON W. DUDAS
*Director of the United States Patent and Trademark Office*